United States Patent [19]

Donomoto et al.

[11] 4,419,389

[45] Dec. 6, 1983

[54] METHOD FOR MAKING CARBON/METAL COMPOSITE PRETREATING THE CARBON WITH TETRAISOPROPYLTITANATE

[75] Inventors: Tadashi Donomoto; Atsuo Tanaka; Masahiro Okada, all of Toyota; Atsushi Kitamura, Otsu; Tetsuyuki Kyono, Kyoto, all of Japan

[73] Assignees: Toray Industries, Aichi; Toyota Jidosha Kabushiki Kaisha, Tokyo, both of Japan

[21] Appl. No.: 413,126

[22] Filed: Aug. 30, 1982

[30] Foreign Application Priority Data

Sep. 3, 1981 [JP] Japan ..... 56-138854

[51] Int. Cl.[3] ..... B05D 3/00; B32B 5/14; B32B 7/00

[52] U.S. Cl. ..... 427/294; 427/299; 428/634

[58] Field of Search ..... 427/294, 299, 383.3; 428/457, 621, 634, 650, 649

[56] References Cited

U.S. PATENT DOCUMENTS

| | | | |
|---|---|---|---|
| 2,920,385 | 1/1960 | Fike et al. | 428/634 X |
| 3,384,463 | 5/1968 | Olstowski et al. | 428/634 X |
| 3,770,488 | 11/1973 | Pepper et al. | 427/299 |
| 4,157,409 | 6/1979 | Levitt et al. | 427/299 |
| 4,223,075 | 9/1980 | Harrigan | 428/614 X |
| 4,341,823 | 7/1982 | Sexton et al. | 428/634 X |

*Primary Examiner*—Michael R. Lusignan

*Attorney, Agent, or Firm*—Stevens, Davis, Miller & Mosher

[57] ABSTRACT

A method for manufacturing a composite material which includes carbon material in a matrix metal by first applying tetraisopropyltitanate to the carbon material so as to wet it, next drying the carbon material which is wetted with the tetraisopropyltitanate, and then combining the carbon material with the matrix metal. This drying may be done by heating up the carbon material which is wetted with the tetraisopropyltitanate to a temperature of 50° C. to 200° C. in the atmosphere. The tetraisopropyltitanate may be dissolved in ethanol when it is being applied to the carbon material. The matrix metal may be a metal selected from the group consisting of aluminum, magnesium, aluminum alloy, and magnesium alloy.

11 Claims, 11 Drawing Figures

(x 500)

(x 500)

(x 400)

(x 400)

(x 100)

METHOD FOR MAKING CARBON/METAL COMPOSITE PRETREATING THE CARBON WITH TETRAISOPROPYLTITANATE

BACKGROUND OF THE INVENTION

The present invention relates to a method for producing material, and, more particularly, relates to a method for producing composite material composed of a reinforcing carbon material such as carbon fibers or graphite particles embedded in a matrix metal.

There are known various types of reinforced materials, in which carbon fibers or graphite particles are embedded in a matrix metal such as aluminum or magnesium or the like to form a composite material, and these carbon/metal composite materials exhibit various excellent properties with regard to mechanical strength and wear resistance and so on which are not exhibited by either of the constituent materials individually. Accordingly the use of such composite materials has become very desirable for a range of applications. Various methods of production for such carbon/metal composite or reinforced material have already been proposed.

One such known method for producing such carbon/metal composite material is called the diffusion bonding method, or the hot pressing method. In this method, a number of sheets are made of carbon fiber and matrix metal by spraying molten matrix metal onto sheets or mats of carbon fiber in a vacuum; and then these sheets are overlaid together, again in a vacuum, and are pressed together at high temperature so that they stick together by the matrix metal diffusing between them. In this method, it is important for the carbon fibers to be well wetted by the matrix metal as it thus diffuses.

Another known method for producing such fiber reinforced material is called the infiltration method, or the autoclave method. In this method, carbon fibers are filled into a container, the carbon fibers are then evacuated of atmosphere, and then molten matrix metal is admitted into the container under pressure, so that this molten matrix metal infiltrates into the carbon fibers. This method, also, requires the use of a vacuum device for producing a vacuum, in order to provide good contact between the matrix metal and the reinforcing material at their interface, without interference caused by atmospheric air trapped in the interstices of the fiber mass. In fact, if the combination of the reinforcing material and the matrix metal has poor wettability, a good resulting fiber reinforced material cannot be obtained; and thus again it is important for the carbon fibers to be well wetted by the matrix metal as it thus infiltrates into said carbon fibers.

There is a further third method known for making carbon/metal composite material, which does not use a vacuum device. In this method, the so called high pressure casting method, after charging a mold with carbon material in the form of fiber or the like, molten matrix metal is poured into the mold and is pressurized to a high pressure exceeding 1000 kg/cm$^2$, and this high pressure forces the molten matrix metal to infiltrate into the interstices of the reinforcing carbon material. Then the combination of the reinforcing carbon material and the matrix metal is cooled down, while still being kept under this high pressure, until all the matrix metal has completely solidified. Further, it has been conceived of to preheat the carbon material before charging the molten matrix metal into the mold. In this high pressure casting method, it is yet again important for the carbon material to be well wetted by the matrix metal as it thus diffuses.

Conventionally known techniques for thus ensuring good wettability between the carbon material and the molten matrix metal include the following process. First the reinforcing carbon material such as carbon fibers is steeped in a mixture of stearic acid and an organic titanium compound such as an ester of titanic acid, so as to cause a coating of this organic titanium compound to adhere to the surface of said reinforcing carbon material. Next either of the following two processes is performed: either (A) a coating of titanium oxide is formed on the surface of the reinforcing carbon material by heating the reinforcing carbon material with said coating of the mixture on its surface to a temperature of about 400° C.; or (B) a coating of titanium carbide is formed on the surface of the reinforcing carbon material by heating the reinforcing carbon material with said coating of the mixture on its surface to a temperature of about 1200° C.

This prior method, in both the forms thereof described above, has the disadvantage that, after bringing together the reinforcing carbon material and the organic compound of titanium in the presence of stearic acid, it is necessary to heat treat the reinforcing coated carbon material at a high temperature of 400° C. or 1200° C.; and in order to prevent oxidation degradation of the reinforcing coated carbon material at this time it is necessary to perform this heat treatment in a reducing atmosphere or in vacuum, which is very troublesome and adds to the cost of the process to a very substantial extent. Further, the choice of the proper organic titanium compound in order to improve the wettability between the reinforcing carbon material and the molten matrix metal which is to be added thereto is important, because, of course, not all of the organic compounds of titanium are effective on improvement of wettability.

Another prior art method which has been used in order to improve the wettability between the reinforcing carbon material and the molten matrix metal which is to be added thereto is as follows. In the case of distributing graphite particles or the like as a reinforcing material throughout the body of a mass of aluminum alloy or the like which is being used as a matrix metal, which has been practiced in order to improve the wear resistance of the resulting material over the wear resistance of a similar material not using graphite additive material, it has been practiced to coat the graphite particles with nickel or copper before they are dispersed in the molten matrix metal.

However, this method of improving the wettability between the reinforcing carbon material and the molten matrix metal suffers from the disadvantage that a part of this nickel or copper coating on the reinforcing carbon material diffuses into the matrix metal while the matrix metal is melted and as said matrix metal is compounded with the reinforcing carbon material. This is likely to alter the characteristics of the matrix metal and accordingly of the final carbon/metal composite material, and may significantly deteriorate the properties of the resulting material.

SUMMARY OF THE INVENTION

The present inventors have, considering the above described problems with respect to conventional methods for improving the wettability between the reinforcing carbon material and the molten matrix metal, carried out various experiments with regard to improving this wettability. In particular, the present inventors have known that, depending upon the type of organic titanium compound used for pretreating the reinforcing carbon material before compounding it with the matrix metal, the efficacy of this organic titanium compound for improving the wettability between the reinforcing carbon material and the molten matrix metal varies dramatically. These experiments will be partly detailed in the following portions of this specification.

Further, the present inventors have known that, depending upon which particular organic compound of titanium is used for this pretreatment of the reinforcing carbon material before compounding it with the matrix metal, it may be possible to omit the step of heat treatment of the pretreated reinforcing carbon material; or at least such high temperatures as 400° C. or 1200° C. which run the risk of oxidization of the reinforcing carbon material if the heating is not done in a reducing atmosphere which is troublesome and expensive to provide, are not required.

In more detail, organic titanium compounds may be broadly classified into three types: esters of titanic acid, titanium chelates, and titanium acylates. Of these three types, the latter two, i.e. titanium chelates and titanium acylates which have generally low reactivity and also are not hydrolytic, have no substantial effect to improve the wettability between the reinforcing carbon material and the molten matrix metal. Of the esters of titanic acid, which are generally expressed by $Ti(OR)_4$, wherein R is alkyl group, tetrastearyltitanate, which is almost not hydrolytic, has no substantial effect of improving the wettability.

Further, the present inventors have known that, considering these esters of titanic acid, those with a molecular weight of 570 or less have better effectiveness on improvement of the wettability between the reinforcing carbon material and the molten matrix metal, than do those with a molecular weight of greater than 570. In particular, tetraisopropyltitanate, which has a molecular weight of 284, and which hereinafter will be designated as "TPT", which has particularly high reactivity, is particularly effective on improvement of the wettability between the reinforcing carbon material and the molten matrix metal.

Based upon the knowledge of the present inventors outlined above, and based upon the problems outlined above with respect to the prior art, therefore, it is the primary object of the present invention to provide a method of manufacture of a carbon/metal composite material, wherein the wettability between the reinforcing carbon material and the matrix metal is improved.

It is a further object of the present invention to provide a method of manufacture of a carbon/metal composite material, wherein the wettability between the reinforcing carbon material and the matrix metal is improved by treatment with an organic titanium compound which is particularly suitable.

It is a further object of the present invention to provide a method of manufacture of a carbon/metal composite material, wherein the wettability between the reinforcing carbon material and the matrix metal is improved as outlined above, which can be practiced at low cost.

It is a further object of the present invention to provide a method of manufacture of a carbon/metal composite material, wherein the wettability between the reinforcing carbon material and the matrix metal is improved as outlined above, which does not require the provision of any special vacuum conditions.

It is a further object of the present invention to provide a method of manufacture of a carbon/metal composite material, wherein the wettability between the reinforcing carbon material and the matrix metal is improved as outlined above, which does not require the provision of any special reducing atmosphere.

It is a further object of the present invention to provide a method of manufacture of a carbon/metal composite material, wherein the wettability between the reinforcing carbon material and the matrix metal is improved as outlined above, which produces a composite material of good physical properties.

It is a further object of the present invention to provide a method of manufacture of a carbon/metal composite material, wherein the wettability between the reinforcing carbon material and the matrix metal is improved as outlined above, which produces a composite material of good physical properties particularly as regards tensile strength.

It is a further object of the present invention to provide a method of manufacture of a carbon/metal composite material, wherein the wettability between the reinforcing carbon material and the matrix metal is improved as outlined above, which produces a composite material of good physical properties particularly as regards bending strength.

It is a further object of the present invention to provide a method of manufacture of a carbon/metal composite material, wherein the wettability between the reinforcing carbon material and the matrix metal is improved as outlined above, which produces a composite material of good physical properties particularly as regards wear resistance.

It is a further object of the present invention to provide a method of manufacture of a carbon/metal composite material, wherein the wettability between the reinforcing carbon material and the matrix metal is improved as outlined above, and in which the matrix metal is smoothly and properly infiltrated into a porous structure of the reinforcing carbon material.

It is a yet further object of the present invention to provide a method of manufacture of a carbon/metal composite material, wherein the wettability between the reinforcing carbon material and the matrix metal is improved as outlined above, and in which air which is initially present in the porous structure of the reinforcing carbon material is efficiently evacuated therefrom.

It is a yet further object of the present invention to provide a method of manufacture of a carbon/metal composite material, wherein the wettability between the reinforcing carbon material and the matrix metal is improved as outlined above, without using vacuum device.

According to the present invention, these and other objects are accomplished by a method for manufacturing a composite material which includes carbon material in a matrix metal, comprising the step of combining said carbon material with said matrix metal, characterized in that before said step of combining said carbon material with said matrix metal, first a step is performed of applying TPT to said carbon material so as to wet it, and next a step is performed of drying said carbon material wetted with said TPT.

According to such a method, the wettability between the reinforcing carbon material and the molten matrix metal is vastly improved.

Further, according to a particular aspect of the present invention, these and other objects are more particularly and concretely accomplished by the above-mentioned method wherein said matrix metal is a metal selected from the group consisting of aluminum, magnesium, aluminum alloy, and magnesium alloy.

According to such a method, particularly, the effect of TPT with regard to improving wettability between the reinforcing carbon material and the molten matrix metal is particularly good.

Further, according to a particular aspect of the present invention, these and other objects are more particularly and concretely accomplished by the above-mentioned method wherein, in said step of drying said carbon material wetted with said TPT, said carbon material wetted with said TPT is heated up to a temperature of 50° C. to 200° C. in the atmosphere.

According to such a method, by the condition that the temperature for heating the reinforcing carbon material which has been treated with TPT is higher than 50° C., it is avoided that any of the TPT should remain in the liquid state without being completely dried, and, by the condition that the temperature for heating the reinforcing carbon material which has been treated with TPT is lower than 200° C., it is avoided that any of the TPT liquid should boil, thereby causing difficulty in obtaining an even coating over the surface of the reinforcing carbon material. Since this maximum temperature for heating the TPT treated reinforcing carbon material is so low as to be 200° C., there is no danger of this heating temperature causing oxidization of the reinforcing carbon material, and accordingly no provision of any special reducing atmosphere, or of a vacuum, for performing such heating in, is required. In fact, this heating of the reinforcing carbon material may be performed in the atmosphere.

Further, according to a particular aspect of the present invention, these and other objects are more particularly and concretely accomplished by the above-mentioned method wherein, in said step of applying TPT to said reinforcing carbon material so as to wet it, a solution of TPT in an organic solvent is applied to said reinforcing carbon material.

According to such a method, although in fact it is possible to use the TPT as a neat liquid, it is considered to be preferable to use the TPT as a solution in an organic solvent. Actually, various organic solvents could be used, and in particular it is possible to use ethanol, propanol, hexane, benzine, carbon tetrachloride, or methyl chloroform. However, ethanol is the preferred organic solvent. The concentration of the TPT in the organic solvent should be at least 5% by volume, and particularly it is desirable that it should be 50% or more by volume. Furthermore, the TPT may be applied to the reinforcing carbon material by steeping the reinforcing carbon material in the TPT or the TPT solution, and in particular when the reinforcing carbon material is in the form of carbon fibers the TPT may be made to penetrate into the carbon fibers by vacuum suction.

The present invention is suitable as a method for forming a carbon/metal composite material which includes carbon as reinforcing material in the form of carbon fibers, porous carbon materials, graphite particles, graphite powder, or other forms. In particular, when the reinforcing carbon material is in the form of carbon fibers, these may be PAN (polyacrylonitrile) type, rayon type, pitch type, or some other types. The diameters of the fibers may be in the range of from 5 to 200 microns or thereabouts, and their form may be continuous fiber, mat, cut fibers, or some other shapes.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims.

In the drawings.

DESCRIPTION OF THE PREFERRED EMBODIMENTS

Figure 1:
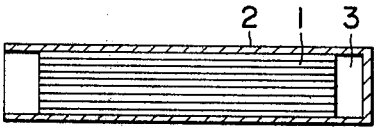
FIG. 1 is a diagrammatical longitudinal sectional view showing the condition of carbon fibers as a reinforcing material being charged in a case according to the method for manufacturing a composite material according to an embodiment of the present invention.

The present invention will now be described with reference to several preferred embodiments thereof, and with reference to the appended drawings. Further, several comparative examples, of substances which are not manufactured according to the present invention, will be shown, in order to make the advantages of the present invention clear.

EMBODIMENT 1

A bundle of continuous carbon fibers was prepared, using 6000 carbon fibers of a high modulus PAN type, each having a diameter of 6 microns. This bundle of carbon fibers was steeped continuously in a 50% solution of TPT in ethanol, and then, after the solution had thoroughly infiltrated the bundle, the bundle was withdrawn from the TPT/ethanol solution and was dried for 30 minutes at a temperature of 100° C. Next, a solution was prepared of acrylic resin solved in methylene chloride, and in this solution was suspended a quantity of aluminum powder having diameters not exceeding 40 microns; i.e. the powder was of about 300 mesh size. The bundle of carbon fibers pretreated as explained above was steeped in this suspension so as to absorb said aluminum powder, and then was dried for 10 minutes at a temperature of 50° C.

Next, this bundle of carbon fibers with aluminum powder absorbed thereinto was cut into lengths each 100 mm long, and these fibers were placed into a metal mold. By applying heat at 580° C. and pressure at 300 kg/cm$^2$ to said carbon fibers, in a vacuum, for 15 minutes, a carbon fiber reinforced aluminum composite material was produced. A first test piece for testing a tensile strength at 0° fiber orientation angle was cut from this carbon fiber reinforced aluminum composite material, so that the fiber axis coincides to the lingitudinal axis of the piece. The piece is 80 mm long, 10 mm wide and 2 mm thick, and a second test piece for testing a tensile strength at 90° fiber orientation angle was also cut from this carbon fiber reinforced aluminum composite material, so that the fiber axis coincides to the traverse axis of the piece. The piece is 50 mm long, 20 mm wide and 2 mm thick.

For comparative purposes, in order to demonstrate the importance of particularly using TPT in the manufacturing process according to the present invention as opposed to using other titanium compounds, first and second test pieces, as COMPARATIVE EXAMPLE 1, corresponding to the first and second test pieces of EMBODIMENT 1, were prepared in exactly the same manner as in EMBODIMENT 1, except that, instead of the 50% solution of TPT in ethanol, a 50% solution of tetrastearoxytitanium (hereinafter called "TST") in benzene was used. The TST has a molecular weight of 1124 and is one of the esters of titanic acid having molecular weight of greater than 570.

For further comparative purposes, in order to demonstrate the importance of particularly using TPT in manufacturing process according to the present invention, as opposed to using no titanium compound at all, similarly first and second test pieces, as COMPARATIVE EXAMPLE 2, corresponding to the first and second test pieces of EMBODIMENT 1, were prepared in exactly the same manner as in EMBODIMENT 1, except that the bundle of carbon fibers was not treated with any solution of TPT such as prepared in EMBODIMENT 1.

The results of the tensile strength testing are shown in TABLE 1. The volume fraction of the carbon fibers in all the test pieces was between 30 and 35%.

TABLE 1

| Composite Material (Treatment) | Tensile Strength (kg/mm$^2$) Fiber Orientation 0° | Fiber Orientation 90° |
|---|---|---|
| Embodiment 1 (TPT Treatment) | 83 | 7 |
| Comparative Ex. 1 (TST Treatment) | 63 | 3 |
| Comparative Ex. 2 (No Treatment) | 65 | 2 |

From TABLE 1, it will be appreciated that by treating the carbon fibers by TPT the tensile strength of the composite material is substantially increased with respect to both 0° fiber orientation angle and 90° fiber orientation angle. The reason for this increase in the tensile strength is considered to be an increased adhesion between the carbon fibers and the matrix metal. Further, it will be seen from TABLE 1 that the TST, which is one of the esters of titanic acid but has a high molecular weight such as 1124, has no ability as comparable to TPT in improving the adhesion between the carbon fibers and the matrix metal.

EMBODIMENT 2

As shown in FIG. 1, carbon fibers 1 of a high modulus type having a diameter of 6 microns and a length of 100 mm were arranged to a bundle in the same orientation, so as to form a bundle of carbon fibers having a volume fraction of 70%. Then, this bundle of carbon fibers was charged into a case of stainless steel (JIS SUS304) having a square section of 10 mm×10 mm and a length of 120 mm, through its open end toward its closed end, while leaving an air space 3 adjacent said closed end. The case 2 thus charged with the carbon fibers 1 was steeped in a 50 volume % ethanol solution of TPT, and then a vacuum drawing was applied to make the solution thoroughly infiltrate the fiber bundle. Then, the carbon fibers 1, as still mounted in the case 2, were dried at 100° C. for 2 hours.

Figure 2:
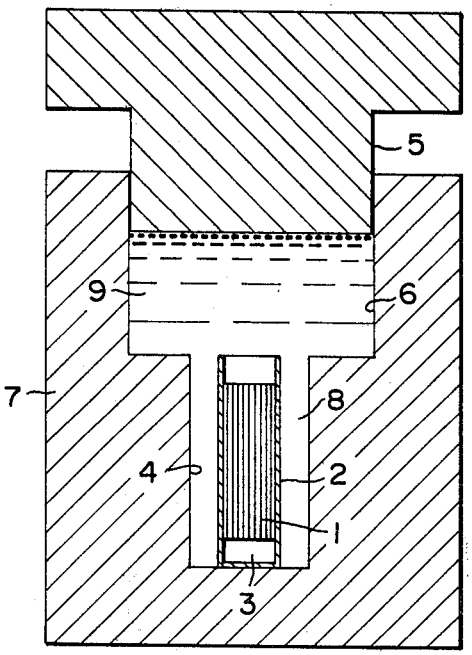
FIG. 2 is a diagrammatical longitudinal sectional view showing the casting process in the method for manufacturing a composite material according to an embodiment of the method of the present invention.

Next, this bundle of carbon fibers with the case enclosing them was heated up to 900° C., and thereafter the bundle of carbon fibers with the case was placed in a receiving chamber 4 formed in a mold 7, as shown in FIG. 2, so as to leave insulation air spaces 8 between the case and the wall of the receiving chamber 4, with the air space 3 in the case 2 being positioned below the carbon fibers 1, and was heated up to 250° C. The mold 1 was further provided with a pressure chamber 6, in which a plunger 5 was engaged. A molten aluminum alloy (JIS AC4C) at a temperature of 750° C. was quickly poured into the pressure chamber 6, and was pressed up to 1000 kg/cm$^2$ by the plunger 5 heated at a temperature of 200° C. This pressed condition was kept until the molten aluminum alloy had completely solidified.

After the molten aluminum alloy in the mold 7 had completely solidified, the solidified body was taken out of the mold, and the case 2 and the solidified aluminum alloy surrounding the case 2 were removed to provide a composite material of the carbon fibers and the aluminum alloy.

For comparative purposes, in order to demonstrate the importance of particularly using TPT in the manufacturing process according to the present invention, as opposed to using no titanium compound at all, a composite material, as COMPARATIVE EXAMPLE 3, was manufactured in exactly the same manner as in EMBODIMENT 2, except that the bundle of carbon fibers was not treated with any solution of TPT such as used in EMBODIMENT 2.

These two kinds of composite materials thus prepared were tested with regard to their bending properties by employing each two kinds of bending test pieces, one having the carbon fibers extending at 0° orientation angle, and the other having the carbon fibers extending at 90° orientation angle. The test results are given in TABLE 2.

TABLE 2

| Composite Material (Treatment) | Bending Strength ($kg/mm^2$) | |
|---|---|---|
| | Fiber Orientation 0° | Fiber Orientation 90° |
| Embodiment 2 (TPT Treatment) | 156 | 9 |
| Comparative Ex. 3 (No Treatment) | 72 | 2 |

From TABLE 2, it will be understood that by applying the TPT treatment to the carbon fibers the bending strength of the composite material is increased more than twice as much in the test pieces having the carbon fibers extending at 0° orientation angle as well as in the test pieces having the carbon fibers extending at 90° orientation angle. The reason for this improvement in the bending strength is considered to be an improvement of the wettability and the adhesion between the carbon fibers and the matrix metal effected by the treatment using TPT.

Figure 3:
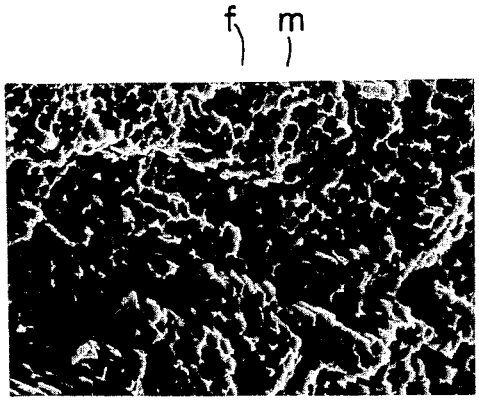
FIG. 3 is a micrograph of 500 magnifications of a fracture surface of a composite material of reinforcing carbon fibers and a matrix of an aluminium alloy manufactured according to an embodiment of the method of the present invention, taken by a scanning type electron microscope.
Figure 4:
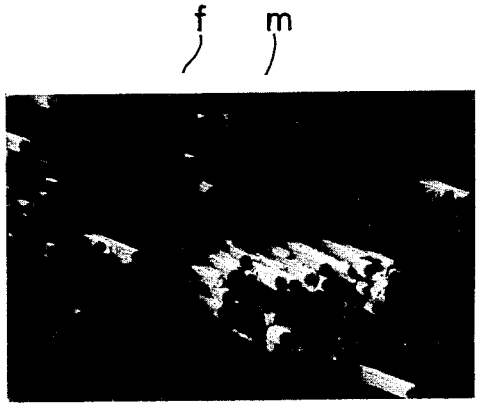
FIG. 4 is a micrograph of 500 magnifications of a fracture surface of a composite material according to a method of comparative example, in which the carbon fibers are not treated by TPT, taken by a scanning type electron microscope.

FIG. 3 is a micrograph of 500 magnifications of a fracture surface of the composite material of the carbon fibers and the aluminum alloy manufactured according to the above-mentioned EMBODIMENT 2 with the TPT treatment, taken by a scanning type electron microscope. On the other hand, FIG. 4 is a micrograph of 500 magnifications of a fracture surface of the composite material of the carbon fibers and the aluminum alloy manufactured according to the above-mentioned COMPARATIVE EXAMPLE 3 with no TPT treatment, taken by a scanning type electron microscope. In these micrographs, f indicates a carbon fiber, whereas m indicates an aluminum alloy.

As seen from these FIGS. 3 and 4, when the TPT treatment was not applied, in almost all area of the fracture surface "pull out" of the carbon fibers occurred. By contrast, when the wettability and the adhesion between the carbon fibers and the aluminum alloy were improved by the TPT treatment, there occurred substantially no "pull out" of the carbon fibers.

EMBODIMENT 3

A composite material was manufactured exactly in the same manner as in the above-mentioned EMBODIMENT 2 by using a bundle of carbon fibers of the same high modulus type and each having a diameter of 6 microns, except, however, that, instead of the aluminum alloy, a magnesium alloy (JIS MDC1A) was used as the matrix material. Also for the purposes of comparison, another composite material composed of the same carbon fibers and the magnesium alloy was manufactured without applying the TPT treatment to the carbon fibers, as COMPARATIVE EXAMPLE 4. As a result of bending tests performed on these two composite materials, it was known that the bending strength of the composite material manufactured with the TPT treatment was 122 $kg/mm^2$ with respect to a test piece having the carbon fibers extending at 0° orientation angle, whereas a test piece of the same dimensions and having the carbon fibers extending at 0° orientation angle taken from the composite material manufactured with no TPT treatment was 80 $kg/mm^2$.

These test results also show the effect of the TPT treatment to the composite material of the carbon fibers and the magnesium alloy for improving the wettability and the adhesion between these materials.

Similar testings were performed with respect to a composite material of carbon fibers and pure magnesium, with similar results as those obtained with respect to the above EMBODIMENT 3 and COMPARATIVE EXAMPLE 4.

EMBODIMENT 4

Figure 5:
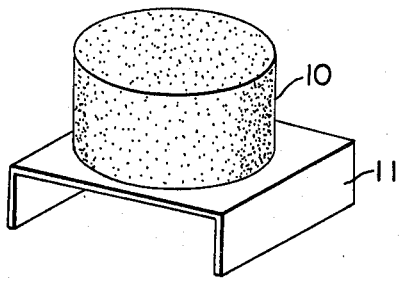
FIG. 5 is a diagrammatical perspective view of a formed carbon body having a porous structure manufactured according to an embodiment of the method of the present invention.

As shown in FIG. 5, a perforated columnar body 10 of carbon having a diameter of 40 mm and a thickness of 20 mm was prepared. The apparent specific gravity and the porosity of the body were 1.05 and 50%, respectively. The body was fixed on a support 11 made of a stainless steel (JIS SUS304). Next, this carbon body was heated up to 800° C. This heated body with the support was placed in a receiving chamber such as the chamber 4 of a mold such as the mold 7 shown in FIG. 2, and molten pure aluminum was poured into the receiving chamber so as to make the carbon body steeped therein and to form a molten aluminum body such as the body 9 in a pressure chamber such as the chamber 6 of the mold 7 in FIG. 2, and thereafter the molten aluminum body was compressed by a plunger such as the plunger 5 in FIG. 2, thereby infiltrating the molten aluminum into the pores of the carbon body 10.

A fracture surface of the composite material thus obtained was examined. The carbon particles and the aluminum matrix were well combined and no separation between them was observed. A friction test performed about this composite material showed that this material had a good tribological behavior.

EMBODIMENT 5

In order to examine whether the method of manufacturing a composite material according to the present invention is applicable to the manufacture of a composite material of carbon fibers as a reinforcing material and a pure zinc as a matrix metal, a composite material of carbon fibers and pure zinc was manufactured in the following manner.

Figure 6:
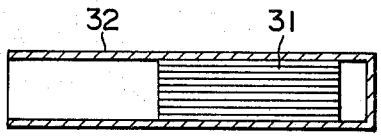
FIG. 6 is a diagrammatical longitudinal sectional view similar to FIG. 1, showing cabon fibers as a reinforcing material charged in a case according to an embodiment of the method for manufacturing a composite material according to the present invention.

As shown in FIG. 6, in the same manner as in the above-mentioned EMBODIMENT 2, carbon fibers 31 of the same high modulus type and each having a diameter of 6 microns and a length of 60 mm were arranged as a bundle, and this bundle was charged into a case 32 made of a stainless steel (JIS SUS304) and having a square cross-section of 10 mm×10 mm and a length of 120 mm, through its open end toward its closed end. The bundle of carbon fibers thus charged into the case had a volume fraction of 70%. The carbon fibers thus charged in the case were treated with TPT treatment in the same manner as in the above-mentioned EMBODIMENT 2.

Figure 7:
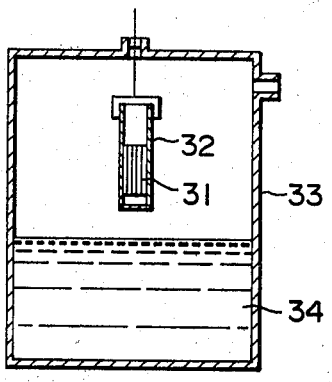
FIGS. 7 and 8 are diagrammatical longitudinal sectional views showing processes in the manufacture of a composite material according to an embodiment of the method of the present invention.
Figure 8:
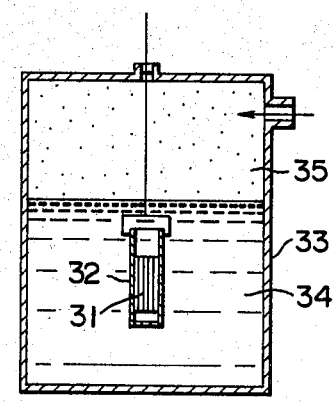

The carbon fibers 31 thus treated were placed in a pressure vessel 33 as shown in FIG. 7, and then molten pure zinc 34 was poured into this pressure vessel and was maintained at 550° C. Then, as shown in FIG. 8, the carbon fibers 31, with the case 32, were steeped in the bath of pure molten zinc. Thereafter, argon gas 35 was introduced into the pressure vessel 33, and was pressurized up to 50 kg/cm$^2$ for 5 minutes.

Next, the carbon fibers 31 and the case 32 were taken out from the bath of pure molten zinc into the atmosphere of the argon gas, while maintaining the pressure of the argon gas at 50 kg/cm$^2$, and were cooled down in that condition until the bath of pure molten zinc solidified. Next, the carbon fibers and the case were taken out from the pressure vessel, and by removing the case a composite material of the carbon fibers and pure zinc was obtained.

For comparative purposes, a similar composite material was manufactured, as COMPARATIVE EXAMPLE 5, exactly in the same manner as in EMBODIMENT 5, except, however, that no TPT treatment was applied to the carbon fibers.

Figure 9:
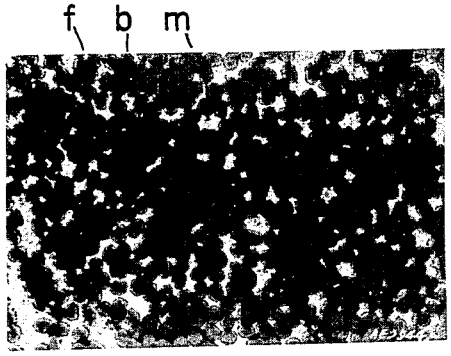
FIG. 9 is a micrograph of 400 magnifications of a transverse section of a unidirectional composite material of carbon fibers and pure zinc manufactured according to an embodiment of the method of the present invention, taken by an optical microscope.
Figure 10:
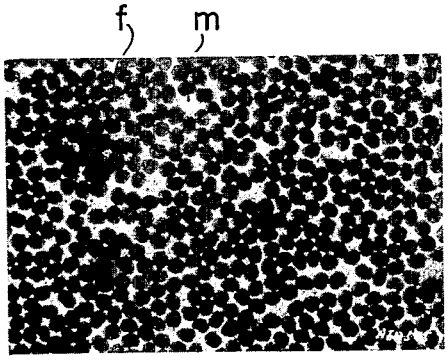
FIG. 10 is a micrograph of 400 magnifications of a transverse section of a unidirectional composite material according to a comparative example not treated by TPT, taken by an optical microscope.

FIG. 9 is a micrograph of 400 magnifications of a transverse section of the unidirectional composite material of carbon fibers and pure zinc manufactured according to the method of EMBODIMENT 5 with the TPT treatment. The micrograph was taken by an optical microscope. FIG. 10 is a micrograph of 400 magnifications of a transverse section of the unidirectional composite material manufactured according to COMPARATIVE EXAMPLE 5. The micrograph was also taken by an optical microscope. In these FIGS. 9 and 10, f indicates a carbon fiber, and m indicates a pure zinc.

By comparing FIGS. 9 and 10, it will be understood that in the composite material manufactured according to EMBODIMENT 5 there exist a relatively large number of voids b in which no pure zinc infiltrated, whereas in the composite material manufactured according to COMPARATIVE EXAMPLE 5 there exists almost no such void. This means that TPT treatment is not desirable for the combination of carbon fibers as the reinforcing material and pure zinc as the matrix metal. Therefore, the present invention is not applicable to a carbon fiber reinforced composite material which uses pure zinc as the matrix metal.

EMBODIMENT 6

An aluminum alloy (JIS AC4C) having a composition of 7 weight percent Si, 0.3 weight percent Mg, and the balance aluminum was charged into a graphite crucible by an amount of 3 kg, and was melted at 700° C. in a melting furnace. Then, the aluminum alloy thus melted was cooled down naturally in the furnace down to 640° C.

Next, from the temperature of 640° C. the molten aluminum alloy was further cooled down in the furnace under agitation applied by a propeller rotated at a speed of 300–400 rpm as driven by a variable speed motor, so that the rate of cooling down should be 20° C. per hour, down to 580° C. at which the ratio of the solid phase was 20–40%. The propeller was made of a carbon steel and its surface was coated with calcium zirconate applied by the flame spraying.

Next, by keeping the molten aluminum alloy at 580° C. under the agitation by the propeller, graphite particles treated by the TPT treatment were added by a rate of 15 g per hour until finally 4 weight % of graphite was added. Thereafter, the crucible was taken out of the melting furnace, and the aluminum alloy was solidified in the graphite crucible.

Figure 11:
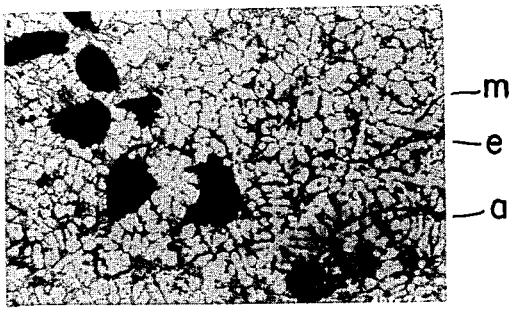
FIG. 11 is a micrograph of 100 magnifications of a section of a composite material manufactured according to an embodiment of the method of the present invention, taken by an optical microscope.

FIG. 11 is a micrograph of 100 magnifications of a section of the composite material thus manufactured, taken by an optical microscope. In this figure, m indicates an aluminum alloy as the matrix metal, a indicates a graphite particle, and e indicates an eutectic Si crystal crystallized in the crystals of the aluminum alloy.

From FIG. 11 it will be understood that the aluminum alloy infiltrated closely to the surface portions of the graphite particles. As a result of friction tests performed on this composite material, it was confirmed that this composite material has a superior tribiological behavior.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

What is claimed is:

1. A method for manufacturing a composite material which includes carbon material in a matrix metal, comprising the step of combining said carbon material with said matrix metal, characterized in that before said step of combining said carbon material with said matrix metal, first a step is performed of applying tetraisopropyltitanate to said carbon material so as to wet it, and next a step is performed of drying said carbon material wetted with said tetraisopropyltitanate.

2. A method for manufacturing a composite material according to claim 1, wherein, in said step of drying said carbon material wetted with said tetraisopropyltitanate, said carbon material wetted with said tetraisopropyltitanate is heated up to a temperature of 50° C. to 200° C. in the atmosphere.

3. A method for manufacturing a composite material according to claim 1, wherein, in said step of applying tetraisopropyltitanate to said carbon material so as to wet it, a solution of tetraisopropyltitanate in an organic solvent is applied to said carbon material.

4. A method for manufacturing a composite material according to claim 1, wherein, in said step of applying tetraisopropyltitanate to said carbon material so as to wet it, a solution of tetraisopropyltitanate in ethanol is applied to said carbon material.

5. A method for manufacturing a composite material according to claim 3, wherein the concentration of tetraisopropyltitanate in said organic solvent is at least 5% by volume.

6. A method for manufacturing a composite material according to claim 3, wherein the concentration of tetraisopropyltitanate in said organic solvent is as least 50% by volume.

7. A method for manufacturing a composite material according to claim 4, wherein the concentration of tetraisopropyltitanate in said ethanol is at least 5% by volume.

8. A method for manufacturing a composite material according to claim 4, wherein the concentration of tetraisopropyltitanate in said ethanol is at least 50% by volume.

9. A method for manufacturing a composite material according to claim 1, wherein, in said step of applying tetraisopropyltitanate to said carbon material so as to wet it, said carbon material is steeped in said tetraisopropyltitanate.

10. A method for manufacturing a composite material according to claim 1, said carbon material being in the form of carbon fibers, wherein, in said step of applying tetraisopropyltitanate to said carbon material so as to wet it, said tetraisopropyltitanate is infiltrated into the carbon material by vacuum suction.

11. A method for manufacturing a composite material according to any one of claim 1 through claim 10, wherein said matrix metal is a metal selected from the group consisting of aluminum, mangesium, aluminum alloy, and magnesium alloy.

* * * * *